United States Patent [19]

Batten

[11] Patent Number: 4,750,390

[45] Date of Patent: Jun. 14, 1988

[54] HAND WRENCHING TOOL FOR INSTALLATION OF TORQUE LIMITED FASTENERS

[75] Inventor: Ronald W. Batten, Torrance, Calif.

[73] Assignee: V.S.I. Corporation, Culver City, Calif.

[21] Appl. No.: 28,710

[22] Filed: Mar. 23, 1987

[51] Int. Cl.[4] ..... B25B 13/28

[52] U.S. Cl. ..... 81/98; 81/94

[58] Field of Search ..... 81/98, 97, 94, 92, DIG. 9, 81/DIG. 10, DIG. 11, 437, 442, 450, 60, 58.5, 58, 57.5

[56] References Cited

U.S. PATENT DOCUMENTS

| | | | |
|---|---|---|---|
| 701,462 | 6/1902 | Bettman | 81/98 |
| 2,878,701 | 3/1959 | Weersma | 81/DIG. 10 |

*Primary Examiner*—Frederick R. Schmidt
*Assistant Examiner*—Blynn Shideler
*Attorney, Agent, or Firm*—Plante, Strauss & Vanderburgh

[57] ABSTRACT

The invention is a wrenching tool useful for installation of the frangible, or torque-limiting, fasteners which are commonly used in the aerospace industry. The tool has a head with a post that is seated in the wrenching ring of fastener and is pivotally mounted on the jaw end of a handle. The jaw end of the handle moves towards the post as the handle is pivoted on the head, and grips against the outside wall of the wrenching collar. If necessary, the wrenching tool is used with a hex key wrench to immobilize the fastener bolt during removal or application of the frangible fastener.

18 Claims, 2 Drawing Sheets

HAND WRENCHING TOOL FOR INSTALLATION OF TORQUE LIMITED FASTENERS

BACKGROUND OF THE INVENTION

1. Field of the Invention

This invention relates to a wrenching tool, and in particular to a hand tool useful for application of torque limited fasteners in minimum distance applications.

2. Brief Statement of the Prior Art

Torque limited fasteners, known as frangible fasteners are used extensively in the aerospace industry. These fasteners employ a threaded nut member which has a threaded locking collar and a distal wrenching ring joined to the locking collar by a neck with a notched section which shears from the collar when the applied torque exceeds a predetermined value. Often the threaded collar has an upset portion, usually a slightly elliptical shape to provide a frictional spring lock that prevents the fastener from spinning off in the event that the residual tension on the fastener is lost.

These fasteners are usually applied with power driven, or hand, wrenching tools having sockets which engage the distal wrenching ring to apply the threaded collar and twist the wrenching ring from the threaded collar when the predetermined torsional loading is exceeded.

It is frequently necessary to apply the torque limiting fasteners in very tight quarters, where a power driver cannot be used. It also becomes necessary to install the fasteners very close to a raised obstruction such as a splice plate, which may have been added to the airframe after initial manufacture. In these minimum edge distance installations, there is insufficient clearance to apply the sockets of conventional wrenches over the wrenching collar of the fastener.

Heretofore, no entirely suitable tool has been devised for these installations. While various hand tools such as pliers and vise grip clamps could be used, they are difficult to use, and their application is not approved, since if they were applied to grip the locking collar directly, the torque limited design of the fasteners would be defeated.

BRIEF DESCRIPTION OF THE INVENTION

This invention comprises a wrenching tool which is designed specifically for the manual installation of collars of frangible fasteners, particularly in close quarters and minimum edge distance applications. For this purpose the wrenching tool has a head which is pivotally attached to a handle and which has a post on its undersurface which can be seated in the wrenching ring of the fastener. The handle has an arcuate cam jaw which preferably has a toothed edge which is pivoted against the outside wall of the wrenching ring, thereby gripping the wrenching ring between the post on the head and the jaw of the handle. Preferably, the post has a coextensive through bore of a sufficient diameter to permit inserting a key to immobilize the bolt of the fastener, as needed for non-interference fit applications.

BRIEF DESCRIPTIONS OF THE DRAWINGS

The invention will be described with reference to the figures of which:

DESCRIPTION OF PREFERRED EMBODIMENT

Figure 1:
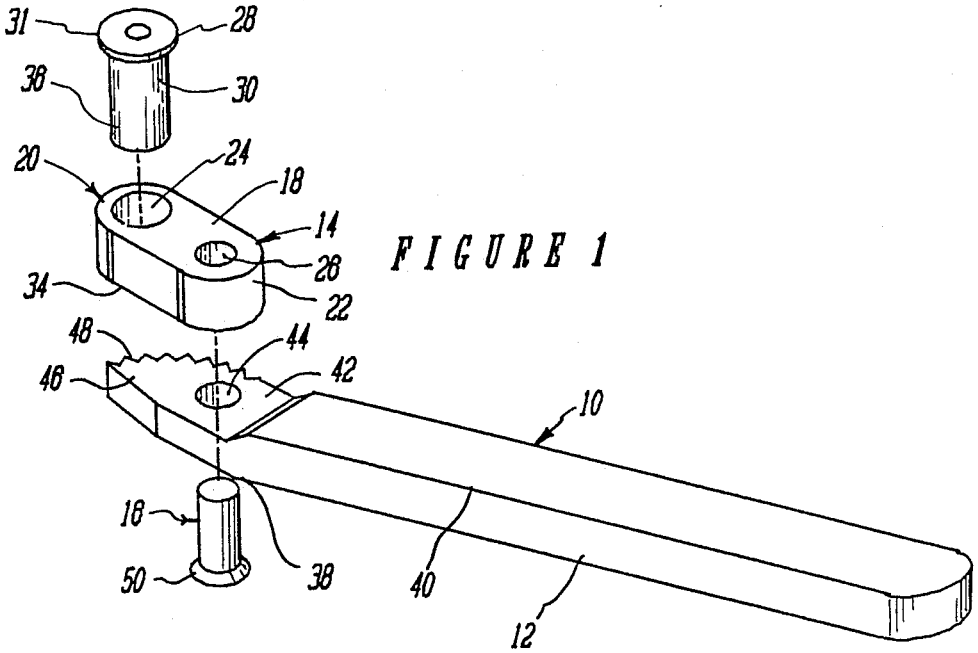
FIG. 1 is an exploded perspective view of the wrenching tool.

Referring now to FIG. 1, the wrenching tool 10 of the invention comprises an assembly of a handle 12 and a head 14 which are pivotally secured together by a pin 16. FIG. 1 illustrates the components in exploded view. The head 14 has an elongated body 18 with arcuate ends 20 and 22, and through apertures 24 and 26 adjacent each end.

A post 28 having a cylindrical base 30 is seated in aperture 24 with a press fit for a permanent installation. The post 28 has a head 31 which seats against the upper surface of head 14, and is of sufficient length to project beneath the undersurface 34 of the head 14. The lower end 36 of the post 28 can be of the same or different diameter than its base 30. Also, if desired, the lower end 36 of the post 28 can be of hexagonal or oval cross section. The cylindrical shape, which is illustrated, is preferred.

At its end 22 which is opposite the end 20 that supports the post 28, the head 14 has a through aperture 26 which tightly receives the pin 16 in a press fit, thereby pivotally securing the assembly of handle 12 and head 14. Preferably the ends of pin 16 terminate flush with the outside surfaces of head 14 and handle 12.

The handle 12 is an elongated bar 40 having a jaw end 42 which has a single through aperture 44 and an arcuate cam 46 which is formed with serrated teeth 48. In its preferred embodiment, shown in FIG. 1, the handle has a 15 degree bend 38 immediately adjacent jaw end 42, thereby providing clearance for the handle above a flat working surface. As illustrated, the elongate bar 40 which forms the grasping portion of the handle can be of slightly greater thickness than jaw end 42 to provide a comfortable grasping surface.

The teeth 48 are spaced at angular spacings of 6 degrees on an arc with a radius which is from 2 to 4, preferably 3 times the distance between the center of aperture 44 and the post 28. The preferred teeth are formed with a 90 degree tooth angle. During ratcheting movements, the jaw will randomly engage against a flat, or against a corner of the hexagonally flatted wrenching ring. The shape and size of the teeth, and the radius of the arcuate cam 46 of the jaw end 42 will provide an optimum arc movement of the handle 12 of about 30 degrees when the backswing of the handle is limited to 90 degrees or less. Of course, if the backswing is limited to about 180 degrees, a greater fastener-advancing arc is possible. The shape of the arcuate cam 46 of jaw end 42 of the tool is further shown in FIG. 2 where the radius of the cam 46 is shown by arrowhead line 47 located on radius center 49 which is beyond and laterally offset from the pin 16 that provides the pivot point for the head 14.

The assembly pin 16 is loosely received in aperture 44, thereby permitting free pivotal movement of the handle 14 relative to head. Preferably, the pin has a tapered head 50 and is received in a countersunk recess 52 (see FIG. 3) in aperture 44, with its end flush with the surface of handle 14.

Figure 2:
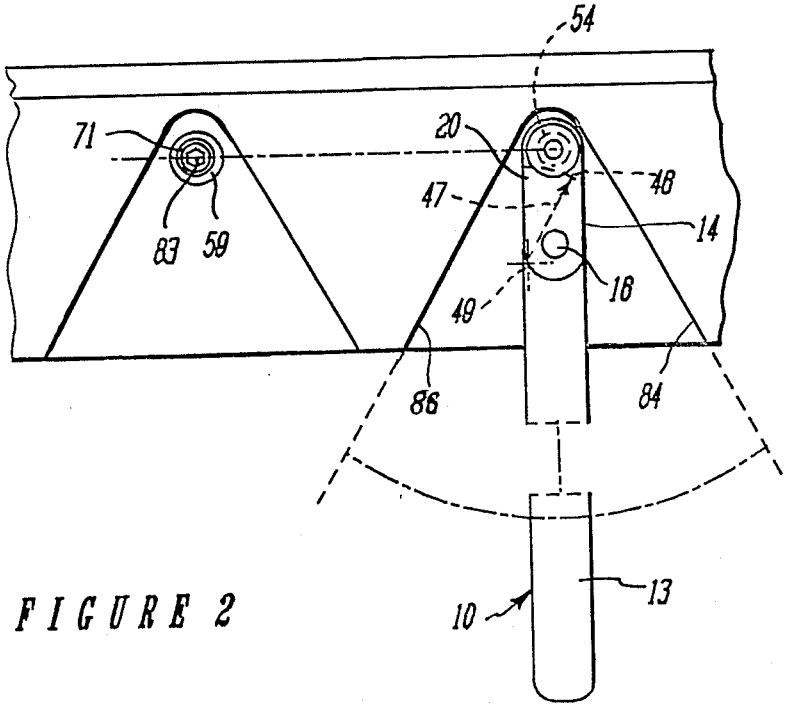
FIG. 2 is a plan view of the application of a fastener with the wrenching tool.
Figure 3:
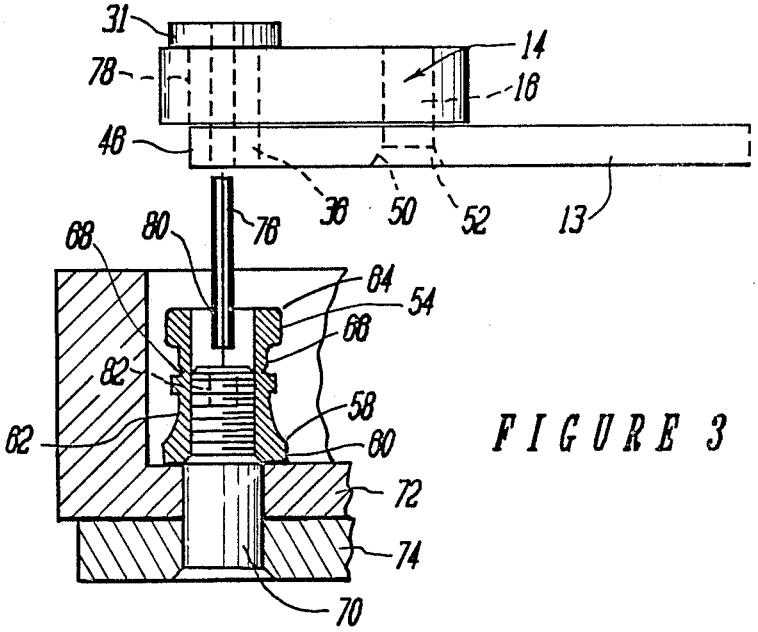
FIG. 3 is a side elevational view of the wrenching tool as applied to the installation of a fastener.

FIGS. 2 and 3 illustrate the applications of the wrenching tool of the invention for the installation of a frangible fastener 54. The wrenching tool 10 is essentially the same as shown in FIG. 1, except it has a straight handle. As shown in FIG. 3, the conventional frangible or torque limiting fastener 54 includes a locking cylindrical collar 58 which has a very narrow base 60 and a conical extension 62. A hexagonally flatted wrenching ring 64 is integrally attached to the top of the conical extension 62 through a neck 66 which has an annular groove 68 to provide a controlled degree of weakening of the neck, so that when the fastening torque exceeds a predetermined permissible value, the neck ruptures, releasing the collar from the wrenching ring. This is a conventional design in which the wrenching collar is secured to the fastener ring through a neck section having a reduced cross section and groove to provide a strain relieved neck.

The fastener 54 is used with a bolt 70 which extends through work pieces 72 and 74. In the illustrated application, the bolt 70 is in a loose, non-interference, fit. A key 76 is to be extended through the central bore 78 of the post member 28, and this key has end flats 80, preferably a hexagonally flatted end, to be inserted into a mating recess 82 in the end of bolt 70. Any suitable supplemental tool such as a hex key, or Allen wrench, can be used for this purpose. This will immobilize the bolt 70 during application of the locking collar.

As shown in FIG. 2, the fastener 54 is to be applied in a minimum edge distance installation, in which the fastener locking collar is almost in contact with the walls 84 and 86 of work piece 72, which is a flat plate with a plurality of triangular notches formed by walls 84 and 86 to receive the fasteners 54. FIG. 2 also illustrates an installed locking collar 61 which secures bolt 71. The hexagonal recess 83 which receives the key 76 is also shown in the end of bolt 71. In this application, upright walls 84 and 86 are too close to the fastener to permit the application of a socket to the wrenching ring 64, and a conventional socket drive cannot be used for the application of the fastener 54. Since the radius of the arcuate end 20 of the head 12 of the wrenching tool 10 is not greater than the radius of the locking collar, however, there is no interference between the head and plates 84 and 86, and the wrenching tool of this invention can be used without encountering any obstruction by the plate.

Figure 4:
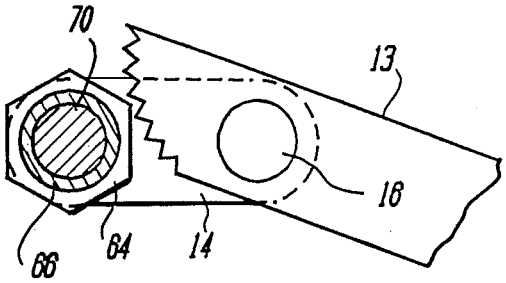
FIG. 4 is a sectional view from the undersurface of the tool, and it is applied to a fastener as shown in FIGS. 2 and 3.

The post 28 of the wrenching tool 10 is seated in the wrenching ring 64 and in this position, the handle 12 is pivoted until the teeth of jaw end 42 grip against the outside wall of the wrenching ring 64. As shown in FIG. 4, the teeth 48 of the jaw end 42 of handle 12 will tightly seat against the corners of the wrenching ring 64. Alternatively, the teeth can also grip against the flats of the wrenching ring. In either case, the ring 64 is securely engaged between the serrated teeth 48 on the arcuate cam end of handle 12 of the tool 10 and post 28. In this position, the rotation of the handle 12 in a clockwise direction as viewed in FIG. 3, will apply a fastening torque to the collar.

Figure 5:
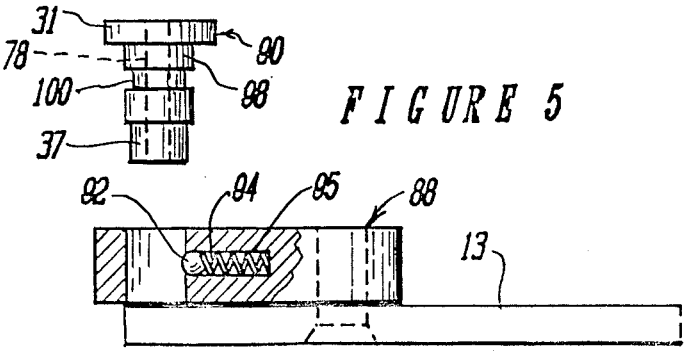
FIG. 5 illustrates an alternative embodiment of the head of the tool.

Referring now to FIG. 5, the wrenching tool can be provided with a plurality of interchangeable posts 90, each of which is sized for a particular size or range of sizes of fasteners. Ideally, the post 90 should have close to the same diameter as the internal diameter of the wrenching collar of the fastener, e.g., its diameter should be within 1/32 to 1/64 inch of the internal diameter of the wrenching ring. Since the wrenching tool is very economical to manufacture, a separate tool can be provided for each size of the fasteners. In some instances, however, it may be too cumbersome for a mechanic to carry many of these tools, and a single tool with interchangeable posts can be provided for those applications. The post 90 is interchangeable with other posts, and has a lower end 37 which is sized for a specific size of fastener. The head 88 of tool 11 has a detent ball 92 mounted in a transverse bore 94 which receives a spring 95 and the detent ball, which projects into the aperture 96 which receives the post 90. Each post 90 has a base 98 which has an annular groove 100 for seating of the detent ball 92, thereby locking the post 90 in the head 88.

The wrenching tool of the invention is specifically designed for the application of frangible fasteners. For this purpose, the wrenching tool is designed to fit within the wrenching ring of the fastener, and cannot be used without the wrenching ring. Accordingly, the tool cannot be used on a locking collar after the wrenching ring has been severed, thus insuring that the torque limiting characteristic of the fastener system cannot be defeated.

The wrenching tool of the invention is of very simple design, yet admirably serves the purpose of manual application of the fasteners that are commonly used in the aerospace industry. The minimum clearance requirements of the head permit the tool to be used for installations of fasteners in minimum edge distance applications. The jaw and tooth design provides optimum arc travel of the handle during ratcheting movement of the tool, thus speeding the installation of the fasteners.

The invention has been described with reference to the illustrated and preferred embodiment. It is not intended that the invention be unduly limited by this disclosure of preferred embodiments. Instead, it is intended that the invention be defined by the means, and their obvious equivalents, set forth in the following claims.

What is claimed is:

1. A wrenching tool for use in minimum edge clearance applications with fasteners having a center aperture and a sidewall extending thereabout, said tool having:

(1) a fastener engaging head with a body having a first through aperture at one end and a second through aperture at its opposite end and having said opposite end arcuate about in said second aperture at a first radius which is not greater than the radius of said fastener and receiving in said second aperture a post which has a diameter permitting it to be seated within said center aperture of said fastener and which projects beneath the undersurface of said head;

(2) an elongated handle having a jaw end with an arcuate end having a radius center, a plurality of teeth on said end, and a distal aperture at a center offset from said radius center, with one side thereof received on the undersurface of said head with said distal aperture aligned with said through aperture of said head; and (3) an assembly pin received in said first through aperture of said socket head and said distal aperture of said handle to pivotally attach said handle to said head, with said first and distal apertures located on their respective head and handle to permit said toothed end edge of said handle to rotate into contact with the external sidewall of said fastener when said handle is pivoted on said head.

2. The tool of claim 1 wherein said post has a central bore coextensive its length to receive a key.

3. The tool of claim 1 wherein the radius of said arcuately beveled end of said handle is greater than the distance between said through aperture and said post, whereby said toothed end edge can be advanced into or retracted from said post by pivotal movement of said head.

4. The tool of claim 1 wherein the radius of said arcuate end of said handle is from 2 to 4 times the distance between said through aperture and said post.

5. The tool of claim 4 wherein said pin is secured in a press fit in said through aperture of said head, flush with the outside surface of said head.

6. The tool of claim 1 wherein said post is one of a plurality of posts having a first diameter end which is received in a detent fit in said second aperture in said head, with each of said plurality of posts having an opposite end of a different diameter than the remaining posts of said plurality.

7. The wrenching tool of claim 6 wherein said head includes:

a. a transverse recess intersecting said second through aperture with a spring biased ball detent received in said transverse recess; and b. a coacting annular groove about the shank of each post of said plurality of posts to receive said ball detent.

8. The tool of claim 1 wherein the head of said pin is countersunk in a mating recess of said head and the end of said head of said pin surface is flush with the surface of said head.

9. The tool of claim 1 wherein said handle has a slight bend intermediate its ends.

10. The tool of claim 9 wherein said bend directs the end of said handle upwardly from the undersurface of said head.

11. The wrenching tool of claim 1 wherein said post is located at a distance from the opposite end of said head which is no greater than the radius of said fastener, thereby permitting installation of said fastener in close proximity to vertical obstructions.

12. The tool of claim 1 wherein said post is received in a press fit in a second aperture through said head.

13. The improvement in a hand wrenching tool for the application of a frangible fastener having a wrenching ring with a central aperture and surrounding sidewall and secured to a subjacent locking ring by a frangible section of reduced cross section which comprises:

(a) a fastener ring engaging head with a through aperture at one end and, adjacent its opposite end therefrom, a post projecting beneath its undersurface with a post end of a diameter to be received within said central aperture of said wrenching ring of said frangible fastener and having said opposite end arcuate about said post at a first radius which is not greater than the radius of said fastener;

(b) an elongated handle having a jaw end with an arcuate cam end having a radius center offset from the axis of said handle to provide said cam end, a plurality of teeth on said cam end, and a distal aperture at a center located on the axis of said handle, with one side of said handle received on the undersurface of said head with said distal aperture aligned with said through aperture of said head;

(c) an assembly pin received in said through aperture of said socket head and said distal aperture of said handle to pivotally attach said handle to said head, with said apertures located on their respective head and handle to permit said toothed end side of said handle to rotate into contact with the sidewall of said wrenching ring when said post is seated in said central aperture of said ring and said handle is pivoted on said head.

14. The wrenching tool of claim 13 wherein said post is located at a distance from the opposite end of said head which is no greater than the radius of said wrenching ring, thereby permitting installation of said frangible fasteners in close proximity to vertical obstructions.

15. The applicator of claim 13 including a coaxial through bore in said socket to receive a key.

16. The wrenching tool of claim 13 wherein said post is removably seated in a second through aperture in said head.

17. The wrenching tool of claim 16 including detent means in said second aperture.

18. The applicator tool of claim 17 wherein said detent means includes:

a. a transverse recess in said head intersecting said second through aperture with a spring biased ball detent received in said transverse recess; and b. a coacting annular groove about said shank of said post to receive said ball.

* * * * *

UNITED STATES PATENT AND TRADEMARK OFFICE

CERTIFICATE OF CORRECTION

PATENT NO. : 4,750,390

DATED : June 14, 1988

INVENTOR(S) : Ronald W. Batten

It is certified that error appears in the above—identified patent and that said Letters Patent is hereby corrected as shown below:

Col 4, Claim 1, line 49, delete: "in"

Col 5, Claim 8, line 33, the word "surface" should follow the word "end" on line 32.

Col 6, Claim 13, line 24, change "side" to --edge--.

Signed and Sealed this

Eighteenth Day of October, 1988

*Attest:*

DONALD J. QUIGG

*Attesting Officer*

*Commissioner of Patents and Trademarks*